US008063796B2

(12) United States Patent
Schmid

(10) Patent No.: US 8,063,796 B2
(45) Date of Patent: Nov. 22, 2011

(54) SMALL VEHICLE DETECTION SYSTEM

(76) Inventor: John Schmid, Litchfield, CT (US)

( * ) Notice: Subject to any disclaimer, the term of this patent is extended or adjusted under 35 U.S.C. 154(b) by 333 days.

(21) Appl. No.: 12/274,114

(22) Filed: Nov. 19, 2008

(65) Prior Publication Data

US 2010/0123601 A1 May 20, 2010

(51) Int. Cl.
*G08G 1/14* (2006.01)

(52) U.S. Cl. ..... 340/932.2

(58) Field of Classification Search ..... 340/932.2, 340/686.1, 933, 937, 943
See application file for complete search history.

(56) References Cited

U.S. PATENT DOCUMENTS

| | | | | |
|---|---|---|---|---|
| 5,745,052 | A * | 4/1998 | Matsuyama et al. | 340/932.2 |
| 6,943,726 | B2 * | 9/2005 | Schneider | 342/70 |
| 6,948,729 | B2 * | 9/2005 | Zalila et al. | 280/204 |
| 2008/0218383 | A1 * | 9/2008 | Franklin et al. | 340/937 |

* cited by examiner

*Primary Examiner* — Phung Nguyen
(74) *Attorney, Agent, or Firm* — McCormick, Paulding & Huber LLP

(57) ABSTRACT

A small vehicle detector for determining a size of a vehicle entering a particular area and assigning a rate of charge based on the determined size of vehicle including an entrance for a vehicle to enter the area. The small vehicle detector further includes a vehicle size detector system for determining size of the vehicle. The small vehicle detector also includes a ticket dispenser for dispensing a ticket with the assigned rate of charge based on the size determined by the vehicle size detector.

20 Claims, 6 Drawing Sheets

SMALL VEHICLE DETECTION SYSTEM

FIELD OF THE INVENTION

This invention relates generally to the field of vehicle size detection systems for use in an entrance to an area.

BACKGROUND OF THE INVENTION

The number of cars that can be parked in a parking facility directly affects the revenue that the facility can take in. The more vehicles parked in a facility, the more revenue generated by that facility. The average parking space can accommodate one large car, but when laid out properly, can accommodate two small vehicles. A reduced rate for small vehicles would provide an incentive for people to drive smaller vehicles while still allowing the amount of revenue a site takes in to increase by allowing for more vehicle capacity.

What is needed is a system that can determine the size of a vehicle upon entering a parking facility so that the optimum amount of cars can be parked in a given parking facility. Further to encourage people to drive smaller cars, the system needs to provide parking rates based on the size of a vehicle.

BRIEF SUMMARY

It is an object of the present invention to provide a small vehicle detection system for a parking facility.

It is another object of the present invention to provide a small vehicle detection system that allows a parking facility to determine rates based on vehicle size.

It is another object of the present invention to provide a small vehicle detection system that utilizes a video system that is installed in an area that will allow the entire drive lane to be within the video image range of the camera.

It is a further object of the present invention to provide a small vehicle detection system that utilizes a video system wherein an image of a car captured by the video system is compared to a preset grid that will determine whether the vehicle falls within certain preset size parameters and the to provide a rate based on the size parameter the vehicle fits into.

It is another object of the present invention to utilize ultrasonic sensors to determine the size of a vehicle entering a parking facility.

It is another object of the present invention to determine the size of a vehicle utilizing ultrasonic sensors that are positioned at pre-determined intervals to ascertain the distance between the absolute front and rear of a vehicle (vehicle size) entering a parking facility.

It is another object of the present invention to utilize both a video-grid system in combination with ultrasonic sensors to determine the size of a vehicle entering a parking facility.

It is another object of the present invention to utilize a video-grid system and/or ultrasonic sensors in combination with a parking system having inductance arming loops, a ticket dispenser with multiple rate printing and encoding capabilities, and a barrier gate.

It is a further object of the present invention to increase the revenue a parking facility can take in by increasing the amount of vehicles that can be parked in the facility.

It is another object of the present invention to provide an incentive for people to drive smaller cars while still allowing the amount of revenue a parking facility can take in by optimizing the amount of vehicles that can park in the facility.

According to one aspect of the present invention, the invention provides a method for determining the size of a vehicle entering into a particular area having an entrance. The method includes the steps of: detecting that the vehicle has entered the entrance to the area; generating a signal instructing a driver of the vehicle to drive the vehicle forward; sensing when the vehicle has pulled forward into a predetermined position; generating a signal instructing the driver of the vehicle to stop the vehicle when the vehicle is sensed to be in the predetermined position; determining the size of the vehicle; associating determined vehicle size with a rate of charge based on the determined vehicle size; generating a signal instructing the driver of the vehicle to push a button on a ticket dispenser; dispensing a ticket containing the determined vehicle size and associated rate of charge information.

According to another aspect of the present invention a small vehicle detector system for determining a size of a vehicle entering a particular area the particular area having an entrance and assigning a rate of charge based on said determined size of vehicle. The small vehicle detector system further includes a vehicle size detector for determining size of the vehicle in the entry lane, and a ticket dispenser for dispensing a ticket with the assigned rate of charge based on the size determined by the vehicle size detector.

According to another aspect of the present invention where the small vehicle detector further includes a barrier gate for preventing the vehicle from entering the area without having a ticket with assigned rate of charge based on size determined by the vehicle size detector. The detector also has an inductance loop for detecting the presence of a vehicle entering said entrance and a driver indicator to instruct a driver of said vehicle to drive the vehicle forward. The detector further includes a front sensor located before said barrier gate to sense when vehicle is in a measurement position.

DETAILED DESCRIPTION OF EMBODIMENTS

Figure 1:
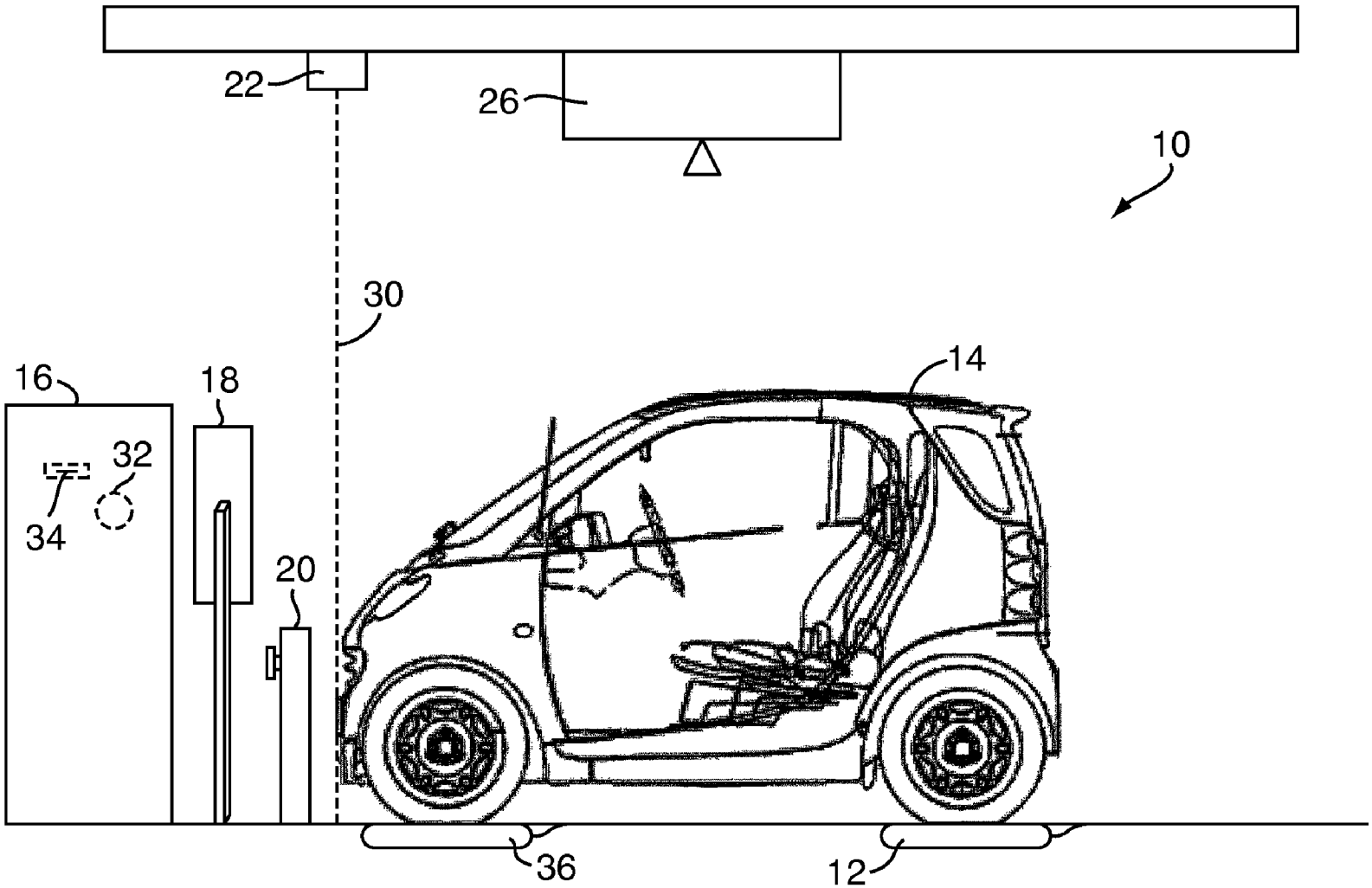
FIG. 1 is a simplified schematic illustration of a vehicle in an entrance to an area that has a small vehicle detector system, provided in accordance with the present invention, having a video grid system for determining the vehicle's size that is in the entry lane.

FIG. 1 is a simplified schematic illustration of an entrance 10 to an area such as a parking facility utilizing an inductance arming loop or loops 12 for detecting the presence of a vehicle 14, a ticket dispenser 16 with dual rate printing and encoding capabilities, a driver indicator 18, and a barrier gate 20. The entrance will also include one or more embodiments of the system of the present invention. The entrance has a vehicle size detector that utilizes sensors and/or a video-grid system 26 with grid measurement and recording capabilities for determining vehicle size.

As a vehicle 14 arrives at the rear of the entrance an inductance arming loop or loops 12 or a sensor 22 will detect the presence of the vehicle and turn on the system. Once the vehicle has been detected pulling into the entrance, the vehicle driver (not shown) will be instructed to pull forward by a driver indicator 18 that provides audio and/or visual information to the driver of the vehicle. There is a front sensor located in the entrance near the barrier gate 20 that detects when the front of the vehicle has pulled forward into a measurement position indicated by the dotted line 30. The front sensor can be a sensor such as an ultrasonic detector 22 or an inductive arming loop 36. The driver will be alerted when the vehicle is in the measurement position 30 by the driver indicator and instructed to stop the vehicle.

Once the vehicle is in the measurement position, determination of the vehicle size can be performed. The entrance has an overhead video-grid system 26 that can capture an image of the entire vehicle in the entrance to the parking facility or other area. The video-grid system will send the image of the vehicle to a microprocessor/video grid processor and place the image over a predetermined grid (not shown) that will determine the size of the vehicle and an associated parking rate. The size of the vehicle will then be displayed on the driver indicator, which can be a light bank or video display, along with instructions for the driver to push a button 32 of a ticket dispenser 16 and a ticket 34 will be printed with the rate that is associated with the determined vehicle size. The barrier gate 20 will then open and allow the driver to drive the vehicle into the parking facility and park the vehicle.

Figure 2:
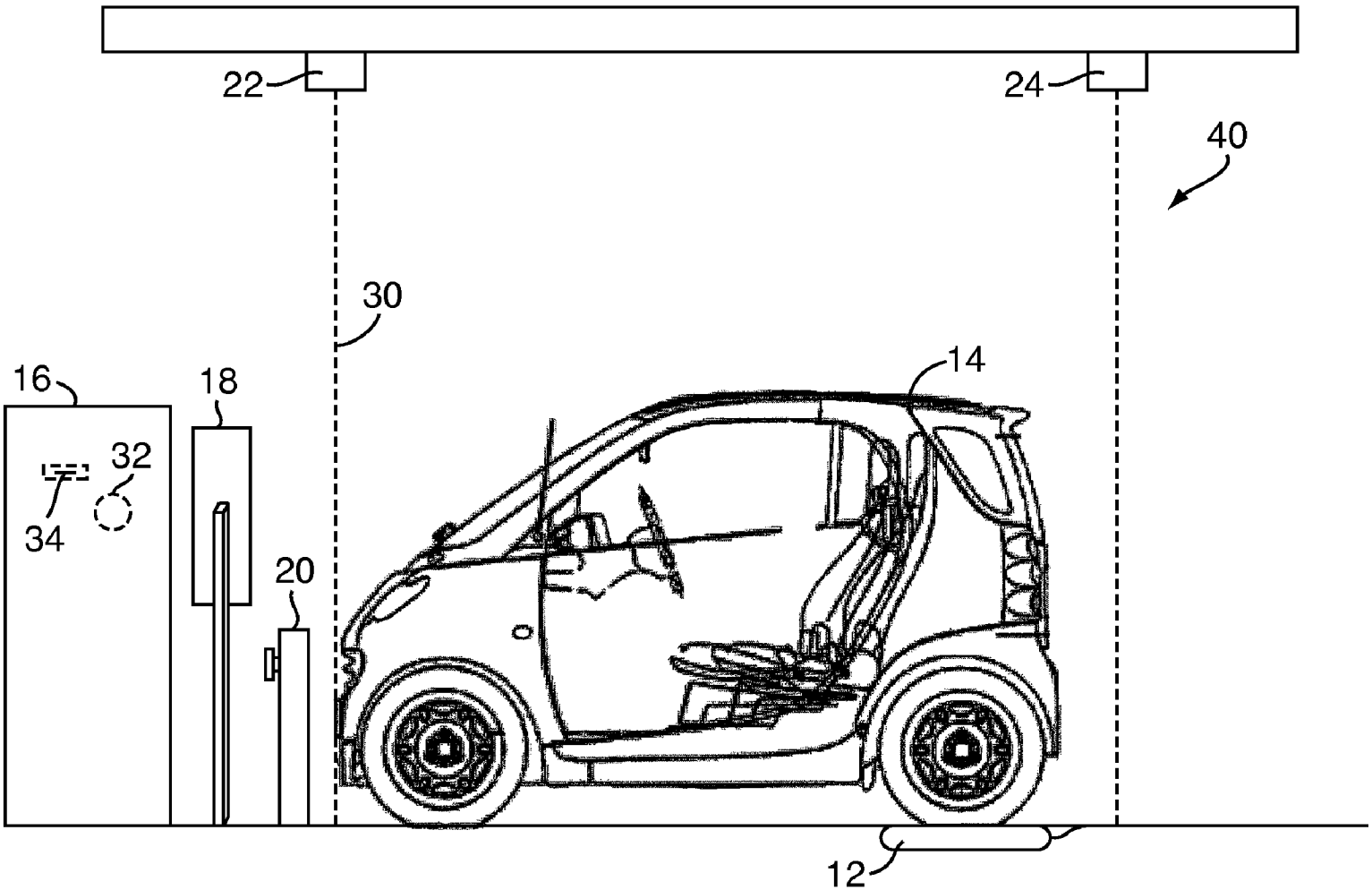
FIG. 2 is a simplified schematic illustration of a vehicle in an entrance to an area that has the small vehicle detector system of FIG. 1 having a front and rear sensor for determining vehicle size.

In FIG. 2, the entrance 40 may also include a rear sensor 24 that is placed in the entrance at a certain distance from the front sensor. In one embodiment of the present invention the distance between the sensors 22, 24 can be predetermined by the parking facility as a distance that if a vehicle is shorter than the vehicle will be considered a small vehicle, if the vehicle is larger than the distance then the vehicle will be considered a large vehicle, and the driver will be charged a small or large rate accordingly. If the vehicle is a small vehicle, when the vehicle is in the measurement position the rear sensor will not detect the presence of the rear of the car, or will detect the vehicle is smaller then the predetermined distance. The vehicle will then be assigned a small car rate. If the car is a large car it will extend beyond the distance between the front and rear sensors and the rear sensor will detect the rear of the car. The car will then be determined to be a large car and assigned a large car rate. Once the system determines whether the vehicle is a small or large vehicle as described above, the driver will then be notified whether the vehicle has been determined a small or large vehicle by the driver indicator and instructed to push the button on the ticket dispenser. The ticket dispenser will dispense either a small rate ticket or a large rate ticket based on the determination of the car size.

The system can also be equipped with more sensors if the parking facility wants more than just a large or small vehicle determination and rate. For example, there could be a third sensor placed at a predetermined distance from the rear ultrasonic sensor. This would allow the system to have three categories (e.g. small, medium, and large) that vehicles can be determined to fit into and charged accordingly. Even more sensors could be added for a more refined and/or expanded range of vehicle size determination.

In another embodiment the rear sensor could be on a movable track or the like (not shown). The rear sensor would start at a position close to the front sensor, for example, two feet. Once the vehicle has been determined to be in the correct position by the front sensor, the rear sensor could then move away from the front sensor and "scan" the vehicle until it finds where the vehicle ends. The distance between the two sensors would then be known and representative of the size of the car and a rate based on the determined size would be assigned/charged accordingly.

Figure 3:
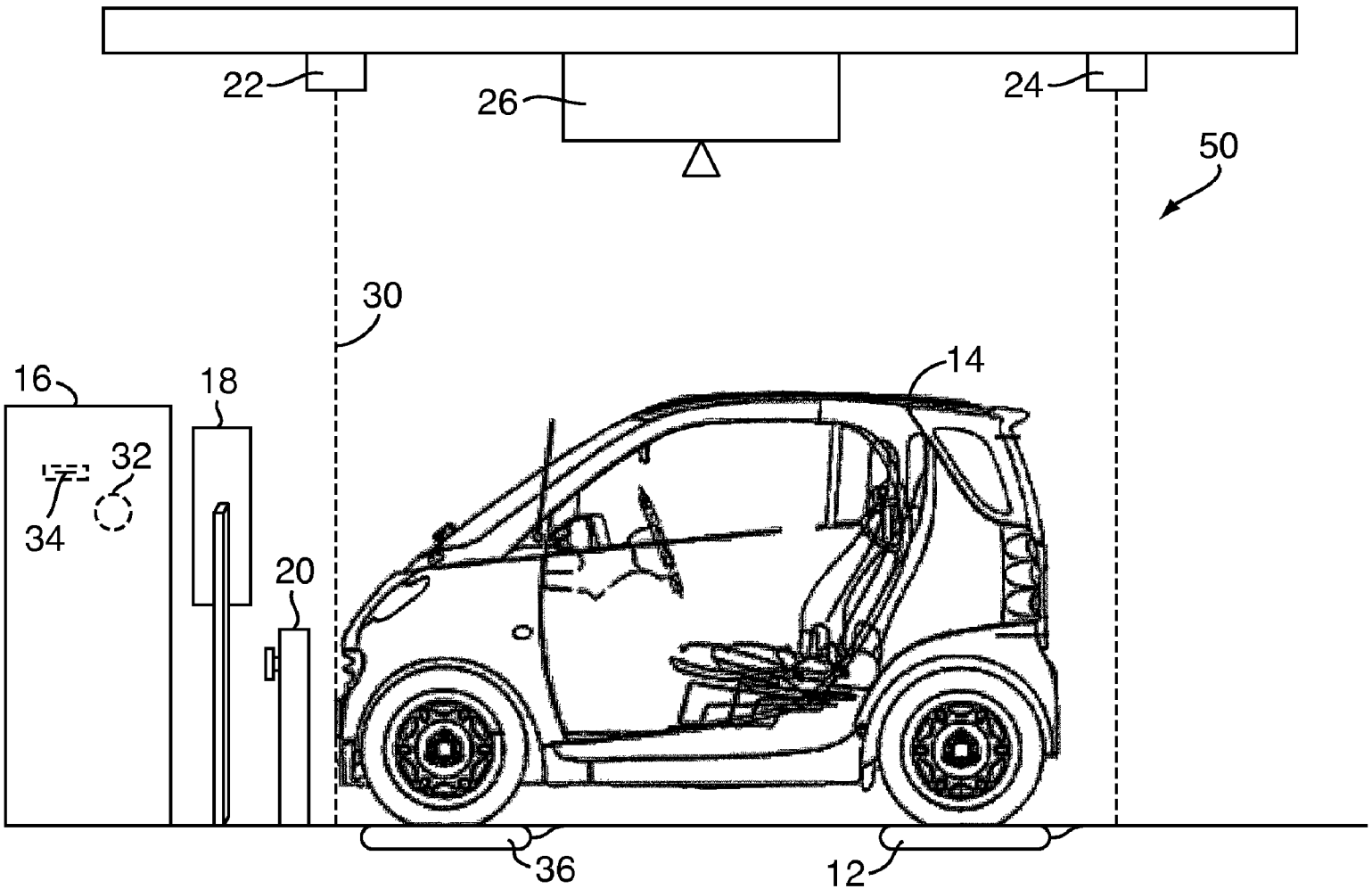
FIG. 3 is a simplified schematic illustration of a vehicle in an entrance to an area that has the small vehicle detector system of FIG. 1 having a video grid system and a front and rear sensor for determining vehicle size.

In another embodiment of the present invention as shown in FIG. 3 the combination of video grid system 26 and sensors 22, 24 could be used together in the entrance 50. This embodiment will work as those mentioned above except that both the video system and ultrasonic setup will determine the size of the vehicle almost simultaneously and when the video grid system and sensors agree on the size of a vehicle, a rate that coincides with that size will be assigned to that vehicle and then a ticket with the appropriate rate will be dispensed.

The sensors, in the embodiments detailed above, are transceivers, preferably of the ultrasonic type, but other sensors well known to a person skilled in the art such as optical beam sensors may also be used. The sensors are preferably located overhead of the entrance to a parking facility, but other arrangements can be utilized.

Knowing the size of each car entering the parking facility will allow the facility to optimize the number of cars that will fit into the facility, which in turn will maximize the parking facilities revenue generated. Further, since the smaller the vehicle the lower the rate charged for parking, it will provide an incentive for people to drive smaller vehicles.

Figure 4:
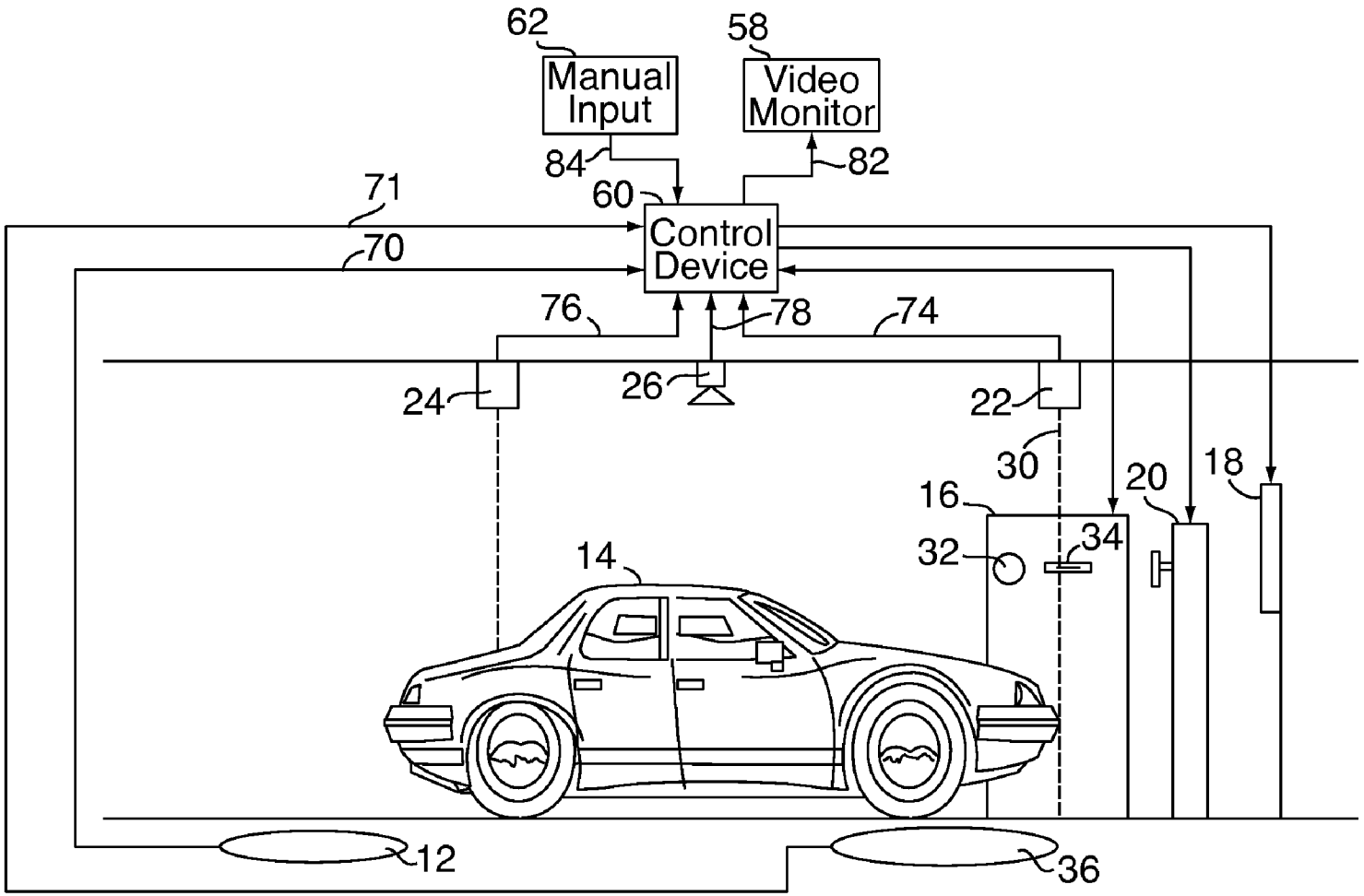
FIG. 4 is a simplified schematic illustration of a control module for use with the small vehicle detector system of FIG. 1 and a diagram, in block form, of a system constituting one embodiment of the invention.

Referring to FIG. 4, the system also includes a control device or module. The control device is preferably a processor and storage device, such as a personal computer, industrial computer, and/or server. The control device includes a microprocessor, memory, and video display with recording capabilities. The control device can be located on site such as an attendant's booth, or in a remote location.

The control module can be operably connected to the sensors, inductance-arming loop or loops, video camera, video recording device, video display, driver indicator display, microprocessor, ticket dispenser and button, and other related components.

Figure 5:
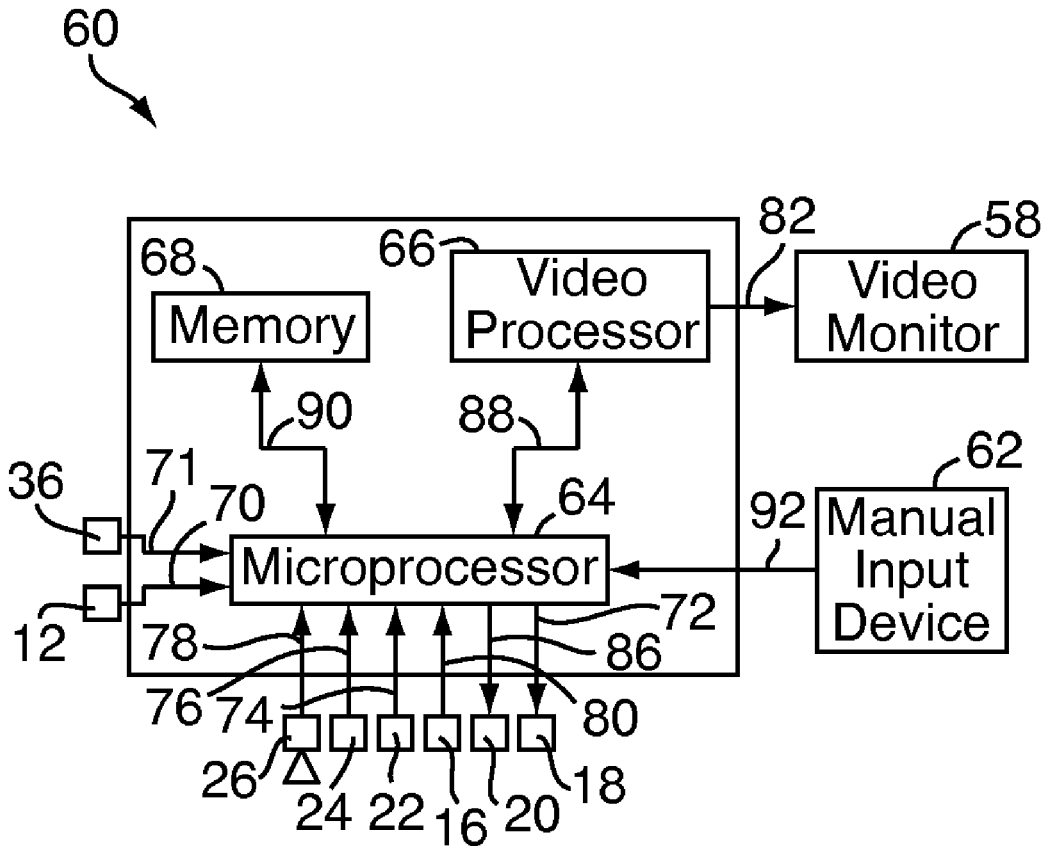
FIG. 5 is a simplified schematic illustration of enlarged view of the control module for use with the small vehicle detector system of FIG. 1 and a diagram, in block form, of a system constituting one embodiment of the invention.

Referring to FIGS. 4 and 5, in operation the system is in a standby mode until a vehicle is detected by a first inductance-arming loop 12. The control device 60 awaits a signal from the first inductance-arming loop. When the first inductance-arming loop detects the presence of the vehicle it will send the signal via signal channel 70 to the control device. Once the control device receives the signal from the sensor, it sends a signal to the rest of the components in the system to exit standby mode and power on.

The control module also generates and sends a signal via signal channel 72 to the driver indicator instructing the driver of the vehicle to drive forward. At this time the control module will continuously monitor the distance between the vehicle and a front sensor 22 and compares it to a value stored in a lookup table in the computers memory. When the distance has reached the value (e.g. zero) stored in the computers memory, the vehicle has reached the measurement position represented by the dotted line 30.

When the front of the vehicle reaches the measurement position as determined by the front sensor 22 or an additional inductance loop 36, a signal is sent via signal channel 71 or 74 to the control device. The control device generates a signal that is sent to the driver indicator 18 via signal channel 72 instructing the driver to stop the vehicle.

Now that the vehicle is in the measurement position, the microprocessor uses the signals sent via signal channels 74 and 76 generated from the sensors 22, 24 to determine the length/size of the car. The microprocessor then compares the determined size to a rate lookup table stored in memory that has rates based on vehicle size via signal channel 90.

The microprocessor takes the image signal generated from the video-grid system 26 and overlays the image on a sizing grid to determine the cars length.

A signal with the video image with grid overlay, the grid determined vehicle size, and sensor determined vehicle size is generated and sent to the video processor 66 via signal channel 88. The video processor converts the signal and sends a converted signal via signal channel 82, to the video monitor 58 so that the image and grid along with the determined vehicle sizes can be viewed.

In a further embodiment the microprocessor can compare the vehicle sizes determined by the video grid system and sensors to see if they match. If the video grid and sensor length determinations match, the microprocessor will generate a signal to send the rate information via a signal channel 80 to the ticket dispenser, and will also generate and send a signal via signal channel 72 to the driver indicator instructing the driver to press the ticket button 32 on the ticket dispenser 16.

If the video grid and sensor length determinations do not match, there are several options of determining a size and rate for the vehicle. The microprocessor can make a decision based on a parking facility's statistical data stored in the system's memory 68. Another option is that a warning could be sent to the video monitor via signal channel 82 so that a parking facility worker/attendant can input a determination via a manual input device 62 and a signal will be generated and sent via signal channel 92 to the microprocessor on what size and rate should be assigned to the vehicle. Still another option would be for the vehicle size detector to quickly re-run the sensors and grid measurement and repeat the comparison.

Again, once the system has determined the size of the vehicle and this information has been sent to the driver indicator via signal channel 72, the driver indicator will inform the driver of the vehicle to press the ticket button.

Since the information of vehicle size has been sent to the ticket dispenser via signal 80, when the driver presses the ticket button on the ticket dispenser the ticket dispensed will be for the rate as determined by the system based on the determined vehicle size.

Once the ticket dispenser has detected that the driver of the vehicle has taken the ticket from the ticket dispenser, the ticket dispenser generates and sends a signal via signal channel 80 to the control module which converts the signal, and the converted signal is sent via signal channel 86 to the gate barrier 20 to open the barrier to allow the driver and vehicle to enter the area/parking facility.

FIG. 5 is an enlarged view of the control device 60 shown with associated signal channels connected to the components of the system, which are schematically represented by blocks. The microprocessor 64 sends and receives signals from the control device's memory 68 via signal channel 90 and to and from the video processor 66 via signal channel 88.

In a further embodiment of the present invention, the control device can be eliminated from all or some of the system components. The system components can be directly wired to each other and any processing and/or signal generation can be done in the individual components.

Figure 6:
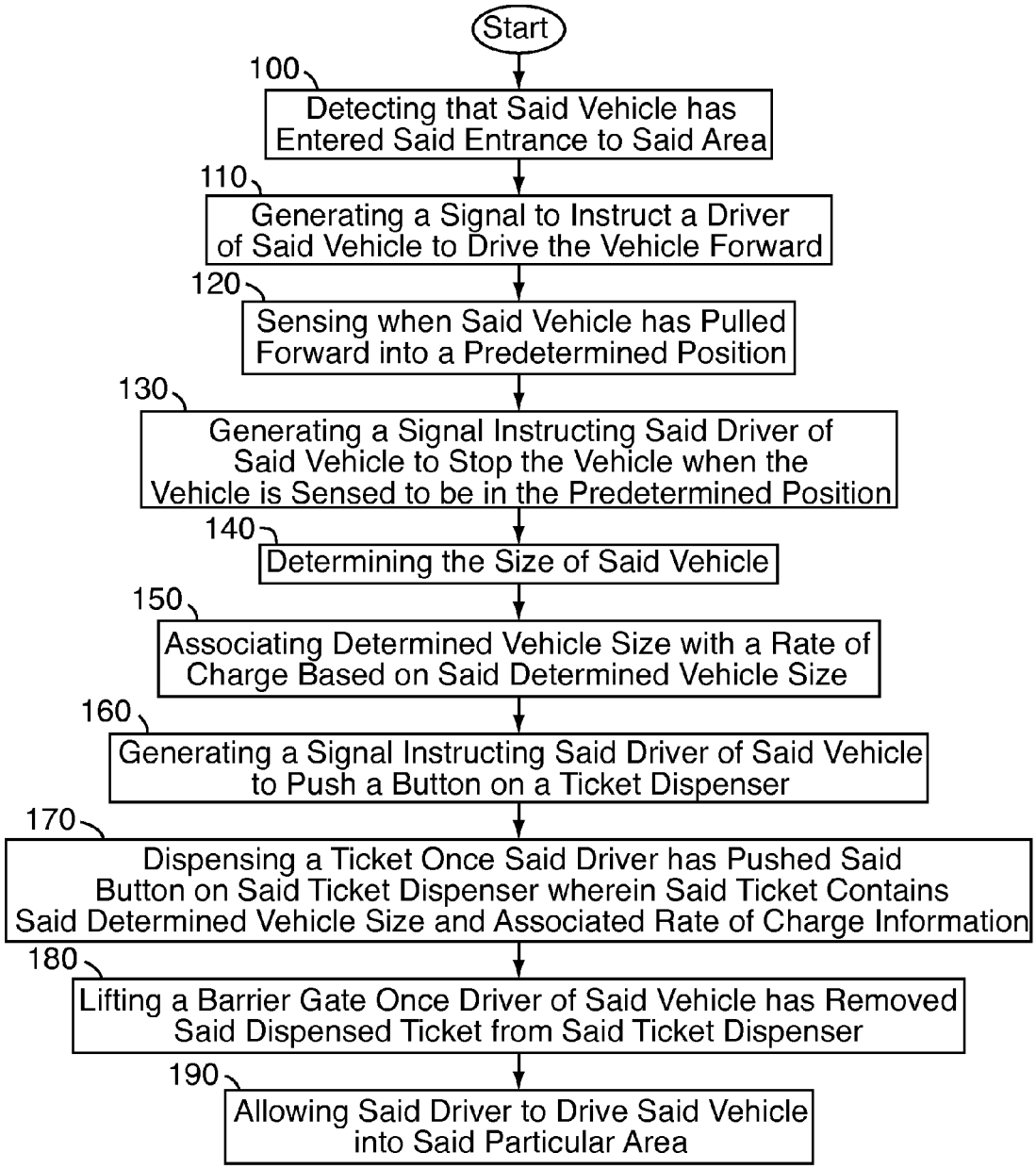
FIG. 6 is a simplified schematic illustration of steps of a method of how the small vehicle detector of FIG. 1 operates in one embodiment of the invention.

FIG. 6 is a simplified schematic illustration of steps of a method of how the small vehicle detector of FIG. 1 operates in one embodiment of the invention. Each step in FIG. 6 is in a box depicted by numerals 100-190. The method starts with step 100 where the small vehicle detector is detecting that the vehicle has entered the entrance to the area 100. Step 110 includes generating a signal to instruct a driver of the vehicle to drive the vehicle forward. Step 120 involves sensing when the vehicle has reached a predetermined position. Step 130 includes generating a signal instructing the driver of the vehicle to stop the vehicle once the detector has sensed the vehicle has reached the predetermined position. Step 140 includes determining the size of the vehicle. Step 150 includes associating the determined vehicle size with a rate of charge based on said determined vehicle size. Step 160 includes generating a signal instructing said driver of said vehicle to push the button on the ticket dispenser. Step 170 includes dispensing a ticket once the driver has pushed the button on the ticket dispenser, wherein said ticket contains said vehicle size and associated rate of charge information. Step 180 includes lifting a barrier gate once the driver of the vehicle has removed the dispensed ticket from the ticket dispenser. Step 190 includes allowing the driver to drive said vehicle into the particular area.

In additional embodiments of the present invention other technologies can be used to supplement the steps of the method of FIG. 6. The vehicle can be detected entering the entrance using an inductance loop. The vehicle can be detected entering the entrance by a sensor located at the rear of the entrance using an ultrasonic sensor. A driver indicator can generate a signal to instruct the driver of the vehicle to drive forward. The sensing of when the vehicle has reached the measurement position can be done by an inductance loop or a front ultrasonic sensor. A signal instructing the driver of the vehicle to stop when it is sensed that the vehicle has reached the measurement position can also be done by a driver indicator. The size of the vehicle can be determined by a video grid system or by a front and rear sensor combination. The front and rear sensors can be ultrasonic or optical beam sensors. Coupling the vehicle size with a parking rate based on the determined vehicle size can be done with a microprocessor. A signal instructing the driver of the vehicle to push the button on the ticket dispenser can be generated using a driver indicator.

The present invention allows a parking facility to optimize the amount of cars that can be parked in the facility by determining the size of each vehicle entering the facility. The present invention allows a parking facility to charge a reduced rate for smaller cars, which provides incentive for people to drive smaller cars while still allowing the amount of revenue the parking facility takes in to increase by allowing the facility to increase its vehicle capacity.

While the invention had been described with reference to the preferred embodiment, it will be understood by those skilled in the art that various obvious changes may be made, and equivalents may be substituted for elements thereof, without departing from the essential scope of the present invention. Therefore, it is intended that the invention not be limited to the particular embodiments disclosed, but that the invention includes all embodiments falling within the scope of the appended claims.

What is claimed is:

1. A method for determining the size of a vehicle entering into a particular area, said area having an entrance, comprising the steps of:

detecting that said vehicle has entered said entrance to said area;

generating a signal instructing a driver of said vehicle to drive the vehicle forward;

sensing when said vehicle has pulled forward into a predetermined position;

generating a signal instructing said driver of said vehicle to stop the vehicle when the vehicle is sensed to be in the predetermined position;

determining the size of said vehicle;

associating determined vehicle size with a rate of charge based on said determined vehicle size; and dispensing a ticket containing said determined vehicle size and associated rate of charge information.

2. The method of claim 1 wherein said step of detecting said vehicle entering said entrance is sensed by an inductance loop.

3. The method of claim 1 wherein said step of detecting said vehicle entering said entrance is sensed by a sensor located at the rear of said entrance.

4. The method of claim 3 wherein the sensor located at rear of said entrance is an ultrasonic sensor.

5. The method of claim 1 further comprising the steps of:

lifting a barrier gate once driver of said vehicle has removed said dispensed ticket from said ticket dispenser; and allowing said driver to drive said vehicle into said particular area.

6. The method of claim 1 wherein said step of sensing when said vehicle has reached said measurement position is sensed by an inductance loop.

7. The method of claim 1 wherein said step of sensing when said vehicle has reached said measurement position is sensed by a front ultrasonic sensor.

8. The method of claim 1 wherein said step of generating a signal instructing said driver of said vehicle to stop when it is sensed that said vehicle has reached said measurement position is done by a driver indicator.

9. The method of claim 1 wherein said step of determining said size of said vehicle is performed by a video grid system.

10. The method of claim 1 wherein said step of determining said size of said vehicle is performed by a front sensor and a rear sensor.

11. The method of claim 10 wherein the front and rear sensors are ultrasonic sensors.

12. The method of claim 1 wherein associating said determined vehicle size with a rate of charge based on said determined vehicle size is done with a microprocessor.

13. The method of claim 1 wherein generating a signal instructing said driver of said vehicle to push said button on said ticket dispenser is done using a driver indicator.

14. A small vehicle detector system for determining a size of a vehicle entering a particular area, said area having an entrance for a vehicle to enter said area, and assigning a rate of charge based on said determined size of vehicle comprising:

a vehicle size detector for determining size of said vehicle in said entrance;

a ticket dispenser for dispensing a ticket with said assigned rate of charge based on size determined by said vehicle size detector.

15. The small vehicle detector system of claim 14 wherein said small vehicle detector system further comprises:

a barrier gate for preventing said vehicle from entering said area without having a ticket with assigned rate of charge based on size determined by said vehicle size detector;

an inductance loop for detecting the presence of a vehicle entering said entry lane;

a driver indicator to instruct a driver of said vehicle to drive the vehicle forward; and a front sensor located before said barrier gate to sense when vehicle is in a measurement position.

16. The small vehicle detector system of claim 15 wherein said driver indicator will alert/instruct said driver of said vehicle to stop the vehicle when said vehicle is in said measurement position and will alert/instruct said driver that the vehicle size has been determined and to press a ticket button on said ticket dispenser.

17. The small vehicle detector system of claim 16 wherein said barrier gate will open allowing said driver to drive said vehicle into said area once said ticket has been taken by said driver from said ticket dispenser.

18. The small vehicle detector system of claim 14 wherein said vehicle size detector consists of said front sensor and a rear sensor are at a predetermined distance from each other to determine the size of said vehicle.

19. The small vehicle detector system of claim 18 wherein said vehicle size detector is a video grid system for determining the size of said vehicle.

20. The small vehicle detector system of claim 18 wherein said vehicle size detector is comprised of the combination of a video grid system and front and rear sensors for determining size of said vehicle.

* * * * *